US008909120B2

(12) United States Patent
Akita

(10) Patent No.: US 8,909,120 B2
(45) Date of Patent: Dec. 9, 2014

(54) IMAGE FORMING APPARATUS AND IMAGE PROCESSING APPARATUS

(75) Inventor: Masanori Akita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 13/608,364

(22) Filed: Sep. 10, 2012

(65) Prior Publication Data

US 2013/0064588 A1 Mar. 14, 2013

(30) Foreign Application Priority Data

Sep. 13, 2011 (JP) ..... 2011-199530

(51) Int. Cl.
*G03G 15/20* (2006.01)
*G03G 15/00* (2006.01)

(52) U.S. Cl.
CPC .. *G03G 15/6585* (2013.01); *G03G 2215/00805* (2013.01); *G03G 2215/0081* (2013.01); *G03G 15/6582* (2013.01)
USPC ..... 399/341

(58) Field of Classification Search
CPC ..... G03G 15/00
USPC ..... 399/341
See application file for complete search history.

(56) References Cited

U.S. PATENT DOCUMENTS 8,086,124 B2 * 12/2011 Zaima ..... 399/53
8,229,340 B2 * 7/2012 Shiozawa ..... 399/341
8,311,471 B2 * 11/2012 Yamada ..... 399/341
8,391,733 B2 * 3/2013 Shiozawa ..... 399/45
8,447,204 B2 * 5/2013 Qiao et al. ..... 399/82
8,521,075 B2 * 8/2013 Shiozawa ..... 399/341
8,634,754 B2 * 1/2014 Shiozawa ..... 399/341
2004/0091296 A1 * 5/2004 Ishizuka et al. ..... 399/329
2010/0196023 A1 * 8/2010 Shiozawa ..... 399/39
2012/0107007 A1 * 5/2012 Qiao et al. ..... 399/82
2012/0128393 A1 * 5/2012 Fujita et al. ..... 399/341
2012/0177426 A1 * 7/2012 Fujita et al. ..... 399/341
2012/0177427 A1 * 7/2012 Fujita et al. ..... 399/341
2013/0164004 A1 * 6/2013 Ai ..... 399/40

FOREIGN PATENT DOCUMENTS

JP 2004-191626 A 7/2004
JP 2004191626 * 7/2004 ..... G03G 15/02

* cited by examiner

*Primary Examiner* — Clayton E Laballe
*Assistant Examiner* — Kevin Butler
(74) *Attorney, Agent, or Firm* — Canon USA Inc. IP Division

(57) ABSTRACT

An image forming apparatus includes a transparent image forming unit configured to form a transparent toner image on a recording material, a fixing unit configured to fix the transparent toner image formed on the recording material, an acquisition unit configured to acquire a region where a mark visually recognizable due to a glossiness difference is to be formed, and a control unit configured to control the transparent image forming unit such that the transparent toner image formed in the region acquired by the acquisition unit is formed in a predetermined pattern in which a first portion having first glossiness after fixing and a second portion having second glossiness after fixing that is different from the first glossiness are at least alternately disposed.

7 Claims, 14 Drawing Sheets

IMAGE FORMING APPARATUS AND IMAGE PROCESSING APPARATUS

CROSS REFERENCE TO RELATED APPLICATIONS

This application claims the benefit of priority from Japanese Patent Application No. 2011-199530 filed Sep. 13, 2011, which is hereby incorporated by reference herein in its entirety.

BACKGROUND OF THE INVENTION

1. Field of the Invention

The claimed invention relates to an image forming apparatus for forming an image by using a transparent toner, and an image processing apparatus for processing image data that is to be transmitted to the image forming apparatus.

2. Description of the Related Art

In a conventional electrophotographic image forming apparatus, a toner image is formed and fixed on a recording material with a chromatic toner (a yellow toner, a magenta toner, a cyan toner, and a black toner) to output a print product. An image to be formed on the recording material is designated by a user. In an output image, regions (hair in a portrait image) using a large amount of toner and regions (skin color or the white of the eye in a portrait image) rarely using a toner are often mixed.

In an image forming apparatus for fixing a toner to a recording material, the glossiness of an image after fixing can be changed according to an amount of toner. This may be because some of the fixed toner influences the surface property of a recording material after the toner is fixed. Accordingly, when an image designated by a user is output onto a recording material, an unintended glossiness difference (uneven gloss) corresponding to the unevenness in an amount of chromatic toner may be generated on the recording material.

However, if the amount of chromatic toner is changed to suppress uneven gloss, a color tone may become different from that of an image to be originally output, which is undesirable.

Therefore, some image forming apparatuses can use a transparent toner, which does not contain a color material such as a pigment, to adjust glossiness after fixing. The transparent toner is also used to set up a measure for security, in addition to suppressing an intended glossiness difference caused by a toner step (convexo-concavity) generated by the chromatic toner. More specifically, Japanese Patent Application Laid-Open No. 2004-191626 discusses a method of intentionally forming a transparent toner image on a portion of a recording material and forming a mark (hereinafter, referred to as 'gloss mark') which can be recognized visually due to a glossiness difference.

However, when a gloss mark is output by using a transparent toner, it becomes difficult to visually recognize the gloss mark if the glossiness of a portion to which the transparent toner is fixed and that of a peripheral portion thereof become incidentally substantially the same. More specifically, even when the glossiness of a portion of a recording medium is intentionally adjusted by using a transparent toner, it becomes difficult to visually recognize an edge (contour) of the gloss mark at a point where the glossiness of a region where the gloss mark is to be formed and the glossiness of a peripheral region thereof are incidentally substantially the same.

More specifically, the glossiness of a portion (white background portion) where a chromatic toner is not fixed to a recording material becomes intrinsic glossiness of the recording material itself. Accordingly, even when a gloss mark is formed at a white background portion, it becomes difficult to visually recognize the gloss mark if the glossiness of a region to which a transparent toner is fixed is substantially the same as the intrinsic glossiness of the recording material.

In addition, images are often formed with a chromatic toner on a recording material on which a gloss mark is formed, and the gloss mark may be formed to overlap the image formed with the chromatic toner. In this case, it becomes difficult to visually recognize the gloss mark if the glossiness of a region to which the transparent toner is fixed is substantially the same as the glossiness of a region to which the chromatic toner is fixed.

If a transparent toner is formed in a region where a gloss mark is to be formed such that the glossiness of the entire gloss mark region becomes substantially the same, it is difficult to visually recognize an edge (contour) of the gloss mark when the glossiness of the gloss mark incidentally coincides with the glossiness of a peripheral portion thereof.

SUMMARY OF THE INVENTION

According to an aspect of the claimed invention, an image forming apparatus includes a transparent image forming unit configured to form a transparent toner image on a recording material, a fixing unit configured to fix the transparent toner image formed on the recording material, an acquisition unit configured to acquire a region where a mark visually recognizable due to a glossiness difference is to be formed, and a control unit configured to control the transparent image forming unit such that the transparent toner image formed in the region acquired by the acquisition unit is formed in a predetermined pattern in which a first portion having first glossiness after fixing and a second portion having second glossiness after fixing that is different from the first glossiness are at least alternately disposed.

Further features and aspects of the claimed invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the claimed invention and, together with the description, serve to explain the principles of the claimed invention.

DESCRIPTION OF THE EMBODIMENTS

Various exemplary embodiments, features, and aspects of the claimed invention will be described in detail below with reference to the drawings.

In an exemplary embodiment of the claimed invention, glossiness (both a light projection angle and a light receiving angle of 60°) was measured by micro-TRI-gloss, which is a product of BYK-Gardner Company. Unless specifically specified, the scope of the claimed invention is not limited by the sizes, materials, shapes, and relative positions of the constituent components of the image forming apparatus.

After describing the entire image forming apparatus, glossiness of an image output on a recording material will be described by using graphs and the like. Thereafter, an operation of the image forming apparatus will be described by using a flowchart.

The image forming apparatus according to a first exemplary embodiment of the claimed invention is an image forming apparatus of the tandem type. As long as a gloss mark can be output on a recording material with a transparent toner, the claimed invention is not limited to that configuration.

Figure 1A:
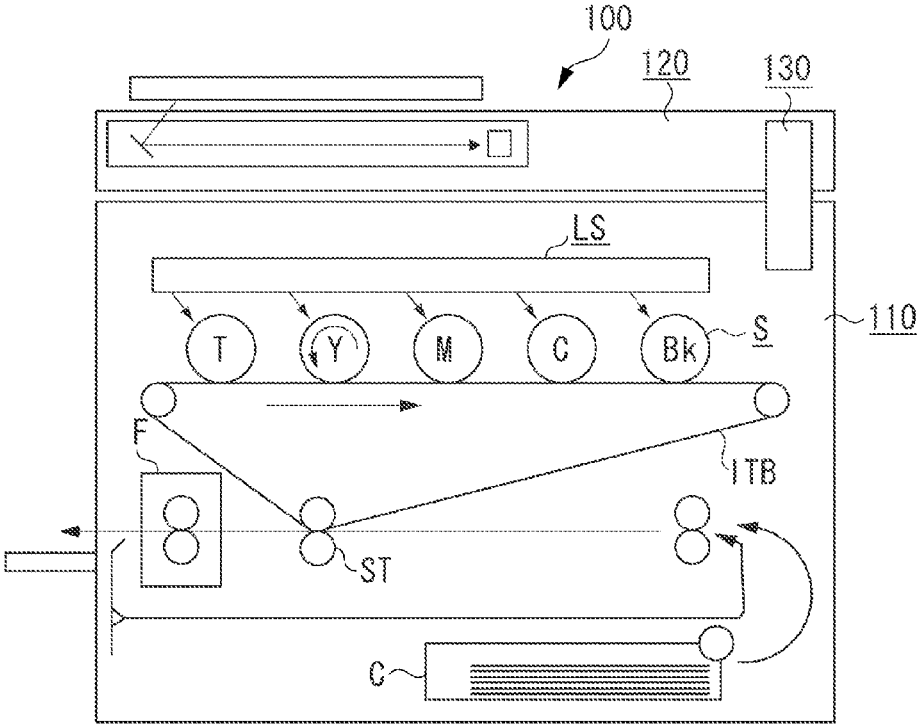
FIGS. 1A and 1B are views illustrating a schematic configuration of an image forming apparatus.

FIG. 1A is a view illustrating a schematic configuration of a multifunction peripheral (MFP) 100 having both a printer function and a scanner function as an image forming apparatus. The MFP 100 as the image forming apparatus of the present exemplary embodiment includes a printer unit 110, a scanner unit 120, and a controller 130 for controlling the printer unit 110 and the scanner unit 120.

The scanner unit 120 may read out a document mounted on a document positioning plate to acquire image data. Further, the printer unit 110 may output image data and the like input from the scanner unit 120 and the outside on the recording material.

Figure 1B:
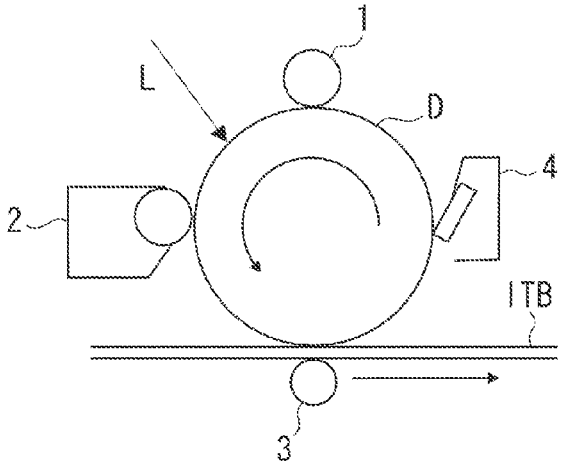

The printer unit 110 includes first to fifth stations (S) Bk to T, and images are formed on respective photosensitive drums with different toners. FIG. 1B is an enlarged detailed view of a station as an image forming unit. Since the respective stations are substantially the same except for the types (spectral characteristics) of the toners developing an electrostatic image formed on a photosensitive drum, the first station Bk will be described representatively.

The station (S) Bk as the image forming unit includes a photosensitive drum D as an image bearing member, and a charging roller 1 as a charging member for charging the photosensitive drum D. After the photosensitive drum D is charged by the charging roller 1, an electrostatic image is formed on the photosensitive drum by exposure L from a laser scanner LS. The electrostatic image formed on the photosensitive drum D is developed on a toner image by a black toner accommodated in a developing device 2. The toner image developed on the photosensitive drum D is transferred to an intermediate transfer belt ITB as an intermediate transfer member by a transfer roller 3 as a transfer member. The residual transfer toner which is not transferred to the intermediate transfer belt and is attached to the photosensitive drum D is cleaned and removed by a cleaning unit 4 including a cleaning blade. Further, the highest resolution of toner images which can be formed on the photosensitive bodies of the respective stations of the present exemplary embodiment is 2400 dpi (dots per inch).

In this way, the toner images transferred from the photosensitive drums D of the respective stations in the sequence of transparent T, yellow Y, magenta M, cyan C, and black Bk are overlapped on the intermediate transfer belt. Further, the overlapped toner images are transferred to a recording material transported from a cassette C in a secondary transfer unit ST. The toner which is not transferred to the recording material in the secondary transfer unit ST but is left on the intermediate transfer belt is cleaned by a belt cleaner (not illustrated).

The toner image transferred onto the recording material is fixed to the recording material by a fixing unit F for contacting the toner to heat and melt the toner and fix the toner to the recording material, and the recording material to which the image is fixed is discharged to the outside of the apparatus. Further, although the toners are overlapped in the sequence of black, cyan, magenta, yellow, and transparent toner (surface) from the recording material in the present exemplary embodiment, the claimed invention is not limited to that sequence.

Next, a two-component developer used in the present exemplary embodiment will be described. First, a known toner where a coloring agent or a charging control agent is added to a binder resin may be used. Further, a toner having a volume average grain diameter of 5 μm to 15 μm may be properly used. In the present exemplary embodiment, a toner having a volume average grain diameter of 6 μm is used for the entire color of transparent T, cyan C, magenta M, yellow Y, and black Bk. The chromatic toner may be prepared such that an optical concentration of the chromatic toner after fixing is 1.6 when an amount of toner on a transfer material is 0.5 mg/cm$^2$. As the transparent toner, particles made of a resin having high optical transmittance and containing no coloring agent may be used.

The transparent toner is substantially colorless, and transmits at least visual rays well substantially without scattering the visual rays. Further, a charging polarity of the toner may be any one of a negative polarity and a positive polarity, but in the present exemplary embodiment, toners having a negative charging polarity are used as the toners of all colors. It is desirable that the melting characteristics of the toners are substantially the same in all the colors of transparent, C, M, Y, and Bk. It is because during the fixing, since all the colors are collectively fixed with the same fixing condition (temperature, pressure, and the like), all the colors need to have an optimum toner melting characteristic where neither a low-temperature fixing defect nor excessive high-temperature melting defect is generated. Further, a known existing carrier may be used. For example, a resin carrier formed by dispersing magnetite as a magnetic material in the resin and dispersing a conductive material such as carbon black in the resin to adjust resistance may be used. Further, although a two-component developing method has been exemplified, the claimed invention is not limited thereto.

Subsequently, a connection relationship of the image forming apparatus of the present exemplary embodiment will be described by using a block diagram.

Figure 2:
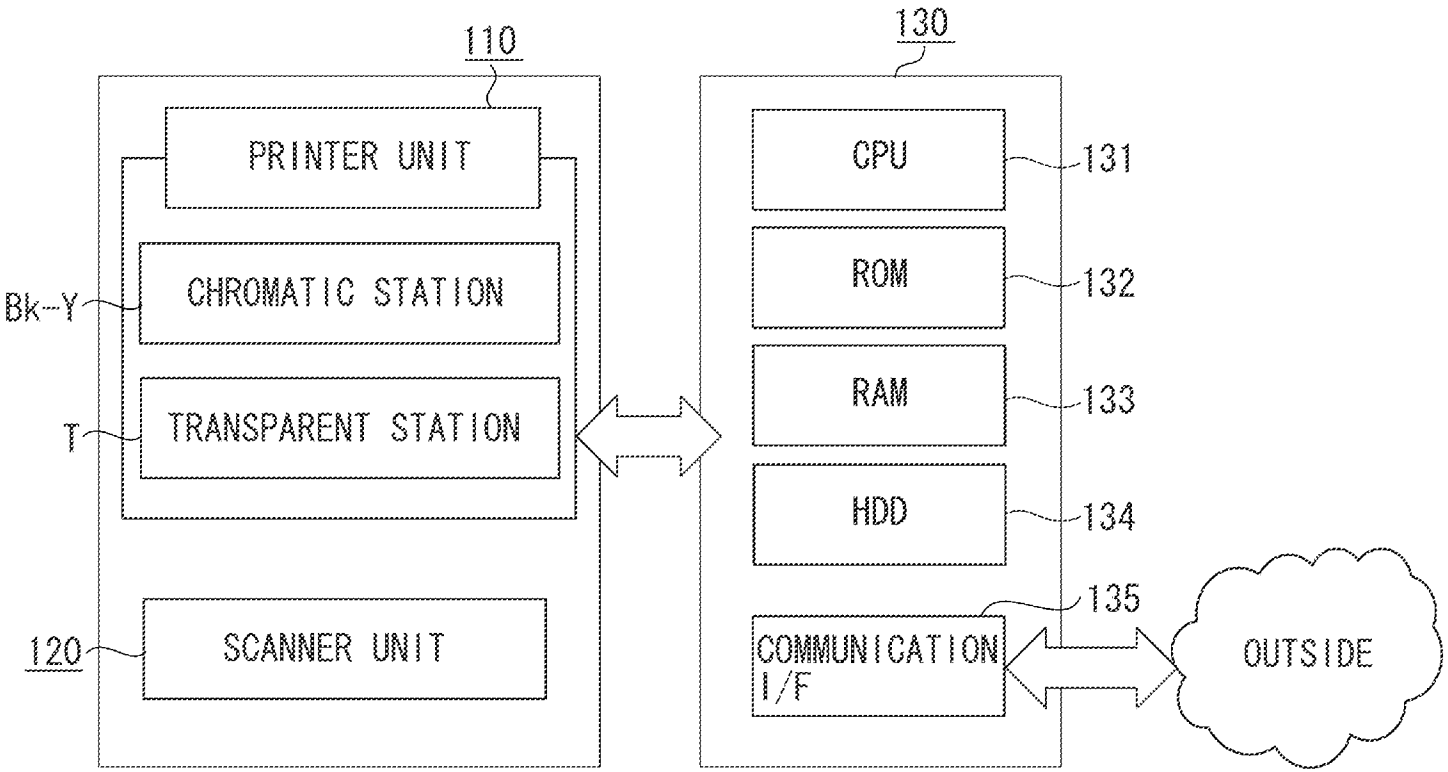
FIG. 2 is a block diagram illustrating a schematic configuration of an image forming apparatus.

FIG. 2 is a block diagram illustrating a connection relationship of the MFP 100 as the image forming apparatus of the present exemplary embodiment. The controller 130 includes a central processing unit (CPU) 131 as a control unit, a read-only memory (ROM) 132, and a random access memory (RAM) 133. The CPU 131 controls the printer unit 110 and the scanner unit 120 according to a program stored in the ROM 132 as a recording unit. Further, the controller 130 includes a hard disk drive (HDD) 134 as a storage unit, and stores image data input from the outside via a communication I/F (interface) 135 or image data acquired by the scanner unit 120.

The controller 130 controls the printer unit 110 (chromatic stations (Bk, Y, M, and C)) or the transparent station T such that a toner image corresponding to image data to be output is fixed onto the recording material. Further, image data to be output may be those stored in the HDD 134 or may be acquired from the scanner 120 or the outside. Further, a control circuit may perform a control operation according to a program, or the control circuit may not be installed in the MFP 100 necessarily.

Hereinafter, an operation of designating a chromatic image and a gloss mark formed on a recording material by using an operation panel (not illustrated) of the MFP 100 will be described. In order to form a chromatic toner image on the recording material, the controller 130 of the MFP 100 processes image data (chromatic image data) for forming a color image. The controller 130 of the present exemplary embodiment converts (image-processes) image data stored in the HDD 134 and the like with red-green-blue (RGB) values of 8 bits (256 gradation levels) into data (YMCK values) which can be used in the printer unit 110. The conversion of the RGB values for producing a full color image to the YMCK values by combining toners of the chromatic engines Bk to Y may be performed through a known processing method.

Next, a method of designating at which position of the recording material a gloss mark which can be recognized by eyes of a person due to a glossiness difference by using a transparent toner is to be formed will be described. In the present exemplary embodiment, an example of producing a gloss mark with a transparent engine T based on information where a user designates a position at which the gloss mark is to be formed will be described.

The user designates at which position of the recording material a gloss mark will be formed by using the operation panel. For example, binary image data converted from the image data (RGB: 8 bits) stored in the HDD 134 may be used to designate a position (position at which the gloss mark is formed). Further, a predetermined mark (mark stored in an HDD and the like) such as 'No Copy' or 'Secret' may be designated as a gloss mark via the operation panel.

Subsequently, glossiness of a print product output to the MFP 100 of the present exemplary embodiment will be described.

If data of an image to be formed on a recording material is transmitted to the printer unit 110 by a user, the printer unit 110 forms and fixes a toner corresponding to an amount designated by the data on the recording material. The toner fixed to the recording material influences the surface property (glossiness) of the recording material according to an amount of toner. A relationship between an image output to the printer unit 110 of the present exemplary embodiment and the glossiness will be described by using graphs.

Figure 3A:
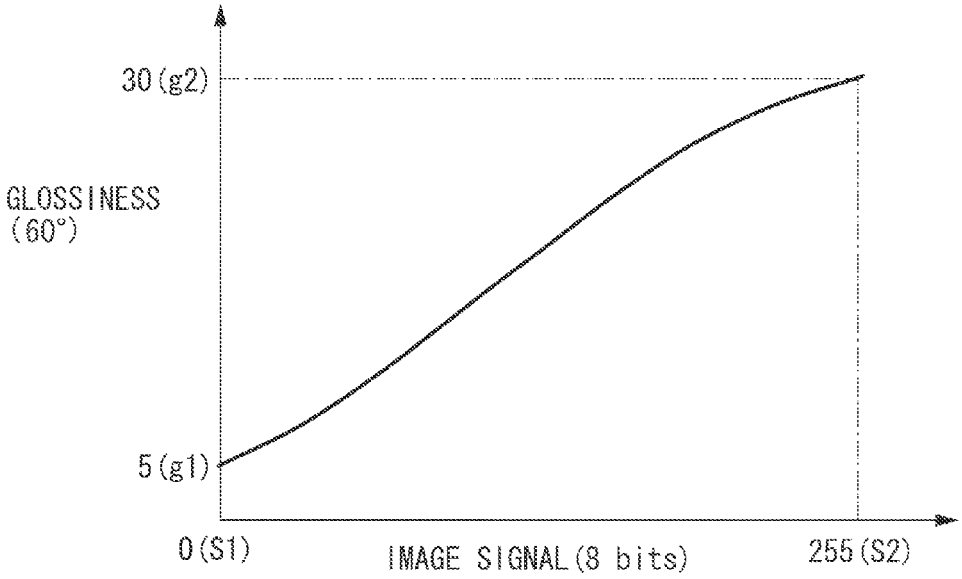
FIGS. 3A and 3B are graphs regarding toner application amounts and glossiness after fixing.
Figure 3B:
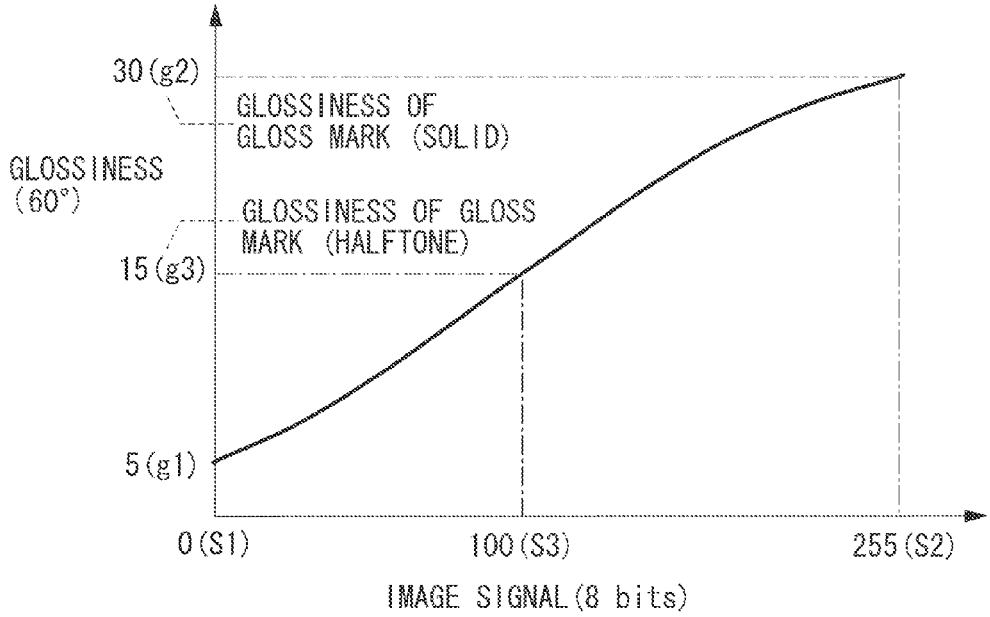

FIGS. 3A and 3B are graphs where signal values of images output to the printer unit 110 of the present exemplary embodiment and the glossiness of print products are compared. In FIGS. 3A and 3B, the vertical axes represent glossiness and the horizontal axes represent image signals. Paper of 157 g/m$^2$ of U-LITE (trade name) manufactured by Nippon Paper Industries Co., Ltd., is used as a recording material of the present exemplary embodiment, and the glossiness g1 of a background portion (signal value (0(S1)) where a toner of the recording material is not fixed is 5. Further, as illustrated in FIG. 3A, it can be seen that an amount of the toner fixed onto the recording material per unit area increases as the image signal value increases, and the glossiness after fixing also increases as the amount of toner increases. In the present exemplary embodiment, one color toner (for example, Y toner) is formed on the recording material to have a maximum toner application amount (signal value 255 (S2): 1.2 mg/cm$^2$), and the glossiness g2 of a point where a toner is fixed to the recording material is 30.

In this way, the glossiness of an output print product is changed according to an amount of toner formed on the recording material having a correlation with an image signal. Further, when a full color image formed by overlapping toners of a plurality of colors on the recording material is formed, a total amount of toner is suppressed through under color removal (UCR) and the like. Accordingly, a maximum toner amount per unit area formed on the recording material has an upper limit of approximately 2.2 colors (2.5 mg/cm$^2$).

Next, the glossiness when a gloss mark is formed on a recording material will be described. FIG. 3B is a graph illustrating the glossiness when a gloss mark is formed in halftone and the glossiness when a gloss mark is formed in solid.

Here, halftone refers to a density portion (approximately 100 level in 8 bits expression: S3) of a halftone using halftone dots, and in the halftone region, the recording material is not entirely covered with the toner. In other words, halftone refers to a halftone region when an expression of gradually growing up halftone dots as density is varied from a low density to a high density by expressing gradation using a screen is employed. Further, when the intensity of an image signal is density of approximately 1 to 200 (8 bits), the image forming apparatus expresses a halftone density by using halftone. Here, since a toner is formed to be arranged in a dot shape when halftone is used, convexo-concavities are formed on the recording material by the toner. If the convexo-concavities are formed on the recording material by the toner, light is irregularly reflected by the convexo-concavities. It is known that glossiness lowers as convexo-concavities are formed on a surface of the recording material.

Further, a solid image refers to an image output when an image signal (S2) (8 bits) of 255 levels is input. A recording material can be entirely covered by a toner when a gloss mark is formed in solid. When a signal intensity expresses a density arranging from halftone of approximately 201 to 255 (8 bits) to a high density, the toner is formed over substantially the entire region of pixels. Accordingly, as the number of convexo-concavities is reduced as compared with the case where halftone is expressed by using halftone, a surface after the toner is fixed is flattened and the glossiness appears high.

As apparently illustrated in FIG. 3B, the glossiness g3 of a gloss mark when the gloss mark is uniformly formed in halftone (HT) is 15. Likewise, the glossiness g2 of a gloss mark when the gloss mark is uniformly formed in solid is 30.

A gloss mark means that a figure (a record, a letter) is formed on a recording material by intentionally providing a glossiness difference which can be perceived visually by a person. In other words, even if a transparent toner is uniformly formed by a predetermined amount in a region where a gloss mark designated by a user is to be formed, the gloss mark often may not be visually recognizable.

Unlike a measuring device such as a glossiness sensor, it is difficult for a person to perceive a slight glossiness difference. In spite of individual variations, a glossiness difference which is difficult to perceive visually by a person is approximately 1 to 3 (60° glossiness). Accordingly, even if a transparent toner corresponding to a predetermined amount per unit area is formed in a designated region (gloss mark region), the transparent toner cannot be visually recognized if the glossiness difference from the periphery is less than approximately 5. That is, even when the transparent toner is formed at a designated place, if a glossiness difference between a point where the transparent toner is fixed and the peripheral point is not sufficient, a gloss mark cannot be consequently recognized visually. Thus, it is desirable that a glossiness difference between a gloss mark and the periphery thereof is equal to or greater than 5 to output a gloss mark having a good visibility.

Figure 4:
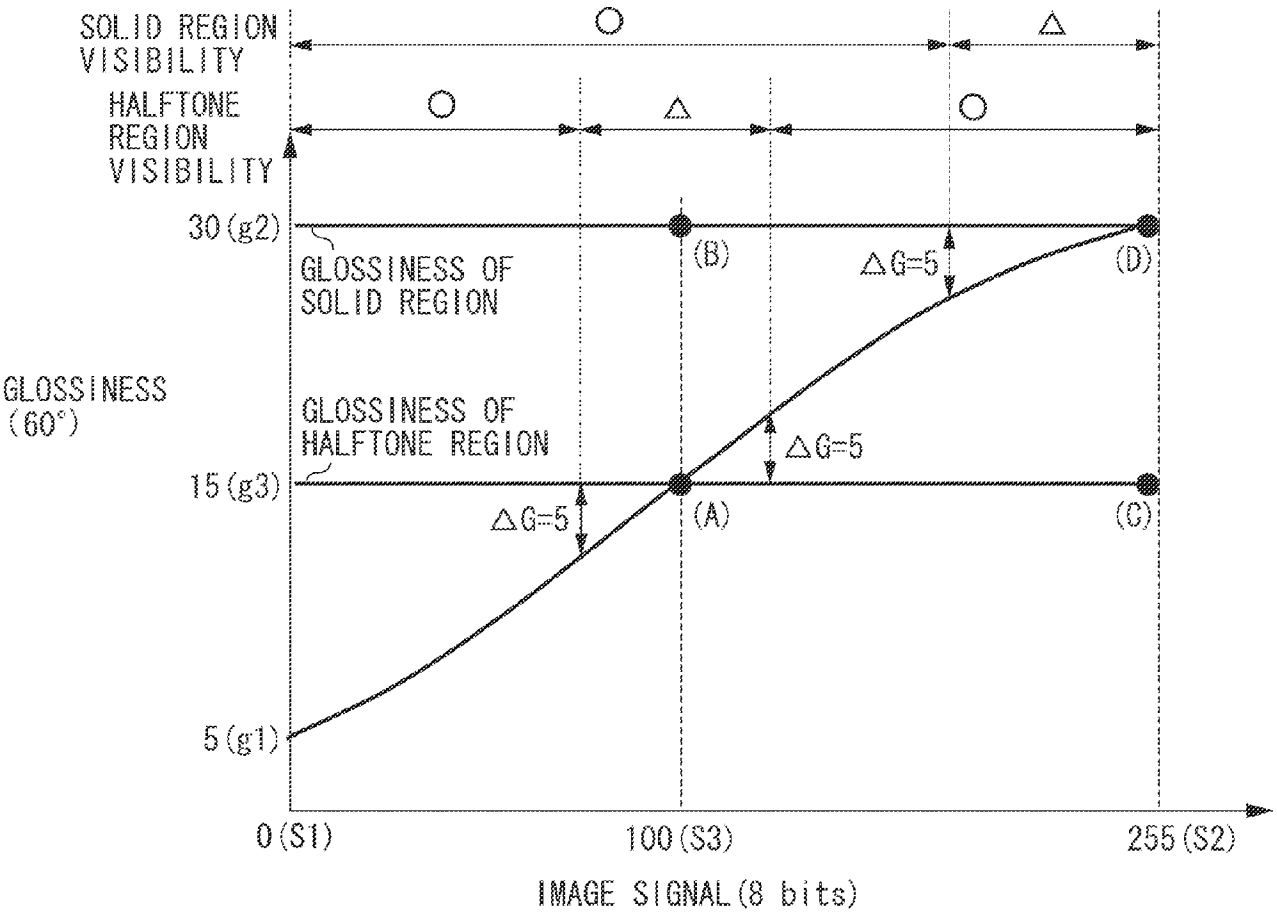
FIG. 4 is a graph illustrating a relationship between a glossiness difference and visibility.

Next, a case where a gloss mark cannot be recognized visually will be described. FIG. 4 is a graph illustrating an influence of a gloss mark formed using a transparent toner by a chromatic image in respect to a visibility.

In order to increase visibility of a gloss mark, it can be considered to form a gloss mark in solid to form the gloss mark with a high glossiness and secure a glossiness difference from the periphery. By forming the gloss mark in solid, the gloss mark can be recognized (○) visually excellently at a point (FIG. 4: B) around the gloss mark where chromatic image density is low. However, in a place (FIG. 4: D) around the gloss mark where chromatic image density is high, it becomes difficult (Δ) to visually recognize the gloss mark.

Thus, it can be considered that an entire region of the gloss mark is formed in halftone. By forming the gloss mark in halftone, the gloss mark can be visually recognized (○) excellently at a point (FIG. 4: C) around the gloss mark where density is high. However, at a point (FIG. 4: A) around the gloss mark where chromatic image density is low, it becomes difficult (Δ) to visually recognize the gloss mark.

In this way, in forming a gloss mark by using a transparent tone, if the glossiness at a portion adjacent to the gloss mark is not considered, a visibility of the border portion deteriorates, so that the gloss mark cannot be recognized visually.

Further, if the transparent toner is apt to be melt extremely as compared with the chromatic toner, since a flatness of the solid region of the transparent toner increases as compared with the solid gloss of the chromatic toner with the same solid and a glossiness becomes higher, the solid region can be recognized as a gloss mark. However, during fixing, both the chromatic and transparent toners are collectively fixed with the same fixing condition (temperature, pressure, and the like). Accordingly, it is not desirable that the transparent toner and the chromatic toner have an extreme melting characteristic difference, which causes a fixing defect. In the present exemplary embodiment, the same binder material is used to make the melting characteristics of the transparent toner and the chromatic toner substantially the same.

Figure 5A:
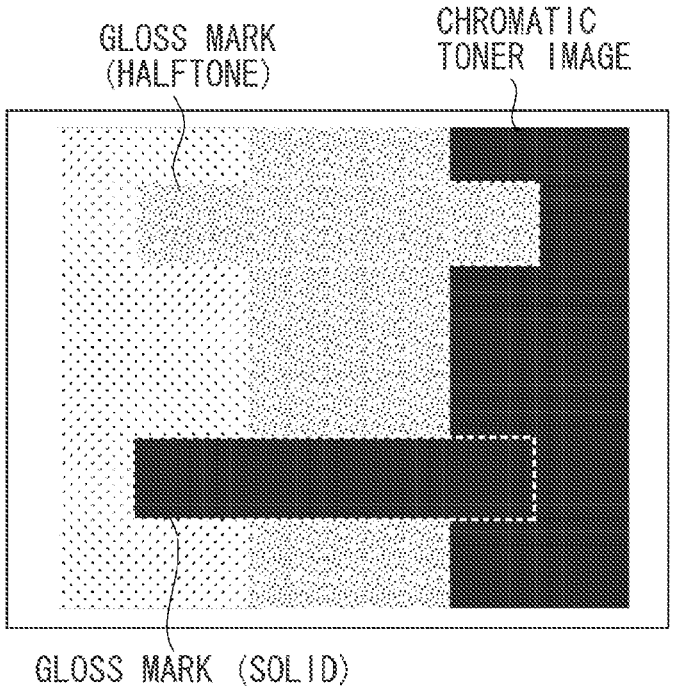
FIGS. 5A and 5B are views illustrating gloss marks (mixed).
Figure 5B:
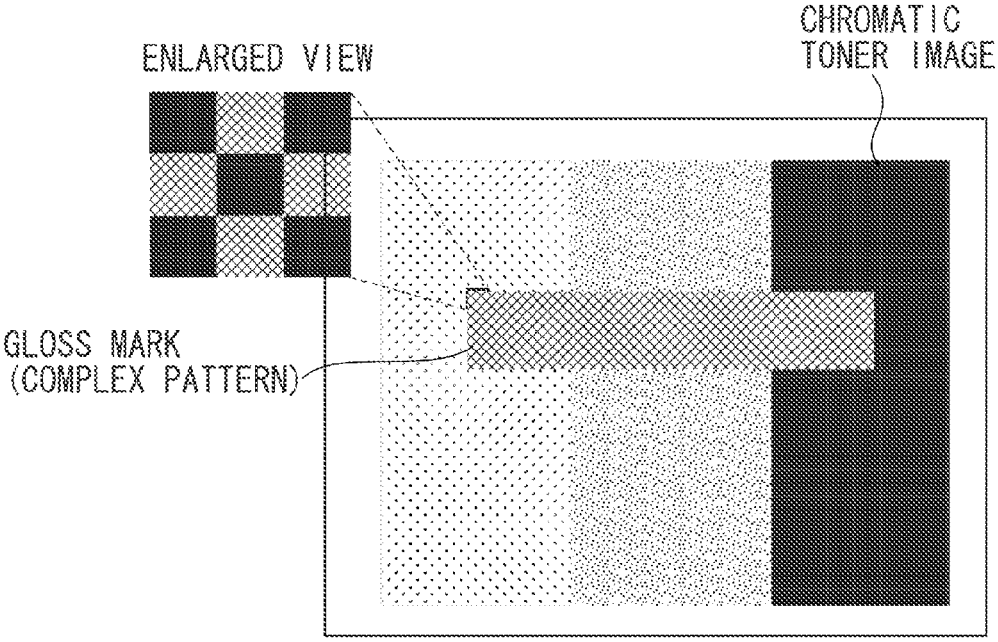

Next, a visibility of a gloss mark will be described with reference to FIGS. 5A and 5B. FIGS. 5A and 5B are views expressing the level of glossiness with black-and-white light and shade. In FIGS. 5A and 5B, a portion where a black color is dark represents a region of high glossiness, and a portion where a black color is light represents a region of low glossiness. Further, an image region (background region) formed by a chromatic toner has a color tone.

The gloss mark is a marking recognizable by a glossiness difference, and the gloss mark region and the peripheral region normally have a glossiness difference. However, when a gloss mark is output to overlap on a chromatic toner, a glossiness difference becomes smaller, thus deteriorating visibility of the gloss mark.

FIG. 5A is a view illustrating that it becomes difficult to visually recognize a border portion of a gloss mark when the gloss mark is uniformly formed in halftone and solid, respectively. A gradation image (background) appearing like the density of an image becomes darker as it goes from the left side toward the right side is formed on a recording material in FIG. 5A by a chromatic toner. Two types of gloss marks are formed by using a transparent toner to overlap a portion (gradation image) where the chromatic toner is fixed.

If the gloss mark is uniformly formed in halftone, since a glossiness difference from a portion (portion with a high density) where an amount of chromatic toner is large is generated, an edge (border) can be excellently recognized visually at the portion. However, since a glossiness difference becomes smaller at a portion (halftone region) where an amount of chromatic toner is small, it becomes difficult to visually recognize an edge at that portion.

On the other hand, if the gloss mark is uniformly formed in solid, since a glossiness difference from a portion (halftone region) where an amount of chromatic toner is small is generated, an edge can be definitely recognized visually at that portion. Likewise, since a glossiness difference becomes lower at a portion where an amount of chromatic toner is large, it becomes difficult to visually recognize an edge at that portion. In this way, in a gloss mark where a predetermined amount of transparent tone is uniformly formed without considering a glossiness after a chromatic image is fixed to a recording material, portions which cannot be recognized visually may be generated.

As described above, if a predetermined amount of transparent toner per unit area is formed such that an entire region to be recognized visually as a gloss mark is formed to have a uniform glossiness, it may be difficult to recognize an edge visually. Thus, according to an exemplary embodiment of the claimed invention, a texture where solid patches and halftone patches are alternately arranged is texture-mapped to an entire region designated to form a gloss mark. Accordingly, a gloss mark having an excellent visibility can be output regardless of the glossiness around the gloss mark.

FIG. 5B is a view illustrating the visibility of a gloss mark output by using a complex pattern. In a texture (in other words, a substituted image pattern or a converted image pattern) used in FIG. 5B, two patches having different glossiness levels are alternately arranged. Further, a texture where not two patches having different glossiness levels but three patches having different glossiness levels are regularly arranged may also produce the same effect.

Next, the arrangement and the size of patches constituting a complex pattern will be simply described.

Figure 6A:
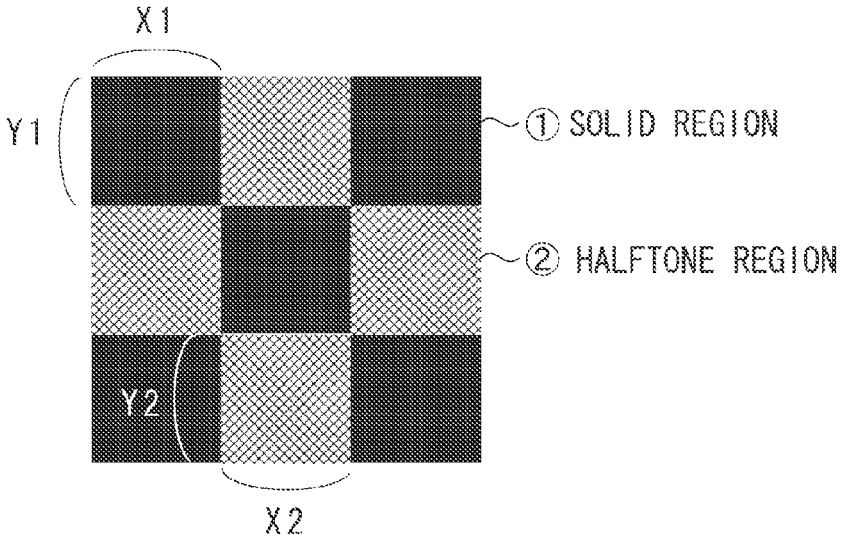
FIGS. 6A and 6B are views illustrating patterns of gloss marks (mixed).

FIG. 6A is an enlarged view illustrating a complex pattern where solid patches and halftone patches are alternately arranged regularly. Further, even when an irregular complex pattern is used, an edge can be recognized visually regardless of the glossiness of the periphery. However, it is unreasonable to regard an edge of a gloss mark as a uniform line due to the glossiness at the periphery depending on a disposition rule or a size of the patches. Accordingly, it is desirable that the patches constituting a complex pattern are alternately arranged regularly.

The complex pattern in the present exemplary embodiment uses a texture where solid patches and halftone patches are alternately disposed in four directions by approximately 500 μm (X1, X2, Y1, and Y2 in FIG. 6A). In other words, the patches having different glossiness levels may be disposed at a rough interval with a resolution equal to or less than 50 dpi (dots per inch) in a predetermined direction of a recording material. It does not matter in which direction of the recording material the patches are periodically disposed.

It is important that the sizes of the solid patches and halftone patches are determined such that a high glossiness region and a low glossiness region are visually distinguished as different regions, and it is desirable that the resolution needs to be low in that sense. That is, it is desirable that the solid patches and the halftone patches are regularly disposed at a rough interval. This is because the solid regions and halftone regions are not viewed if the resolution is high, and thus start to be viewed as a uniform middle glossiness region. Further, this is because if a gloss mark starts to be viewed as a uniform middle glossiness region, it cannot be clearly distinguished from a gloss of a chromatic image. However, if the resolution is too low and a gloss mark image having a fine shape is drawn, a jagged feeling of an edge increases and a figure different from a figure to be originally drawn may be recognized visually, which is undesirable.

Further, as a difference between a high gloss region (g2) of a solid patch of a gloss mark and a low gloss region (g3) of a halftone patch thereof becomes smaller, both the patches start to appear as the same gloss and cannot be clearly distinguished from a gloss region of a chromatic image.

In this regard, the visibility of an edge of a gloss mark can be enhanced by making the glossiness after fixing of the halftone patch portion lower than the glossiness after fixing of the solid patch portion by 5 or more. Further, an amount of transparent toner formed on the recording material is set such that a difference between the glossiness after fixing of the solid patch portion and the glossiness after fixing of the halftone patch portion is equal to or greater than 10 in the present exemplary embodiment.

Figure 6B:
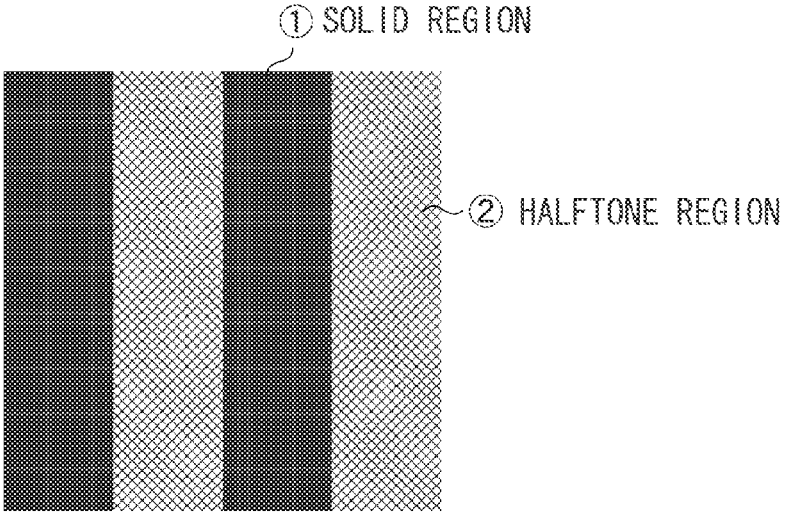

Another example of a complex pattern will be described. Two patches having different glossiness levels after fixing may be either disposed in a tile shape as in FIG. 6A or disposed in a vertical stripe shape as in FIG. 6B. As illustrated in FIG. 6B, when at least two types of patches whose glossiness levels are different are alternately arranged at a low resolution, an edge (contour) of a gloss mark can be perceived regardless of the glossiness at the periphery even in the case of a vertical stripe-shaped texture. Further, in the patterns formed in a region where a gloss mark is formed, regions having different glossiness levels may be regularly disposed regardless of the disposition rule such as a vertical stripe shape, a horizontal stripe shape, and the like. Further, the disposition rule of the patches is accompanied by the following characteristics More specifically, if the patches are regularly disposed in a tile shape, an edge of a gloss mark appears jagged. However, an edge position of the gloss mark designated by a user rarely deviates. Further, if the patches are regularly disposed in a stripe shape, a jagged feeling is reduced in a short lengthwise direction of the stripe. However, an edge appears jagged at an end of a long lengthwise direction of the stripe like in the case of disposition in a tile shape. Accordingly, it is desirable that how at least two patches having different glossiness levels are arranged is determined by selecting an appropriate pattern according to the user's intention.

Hereinafter, an operation of the image forming apparatus, which is performed until the image forming apparatus outputs a gloss mark after the user designates a portion where a gloss mark is formed will be described with reference to the flowchart of FIG. 7.

Figure 7:
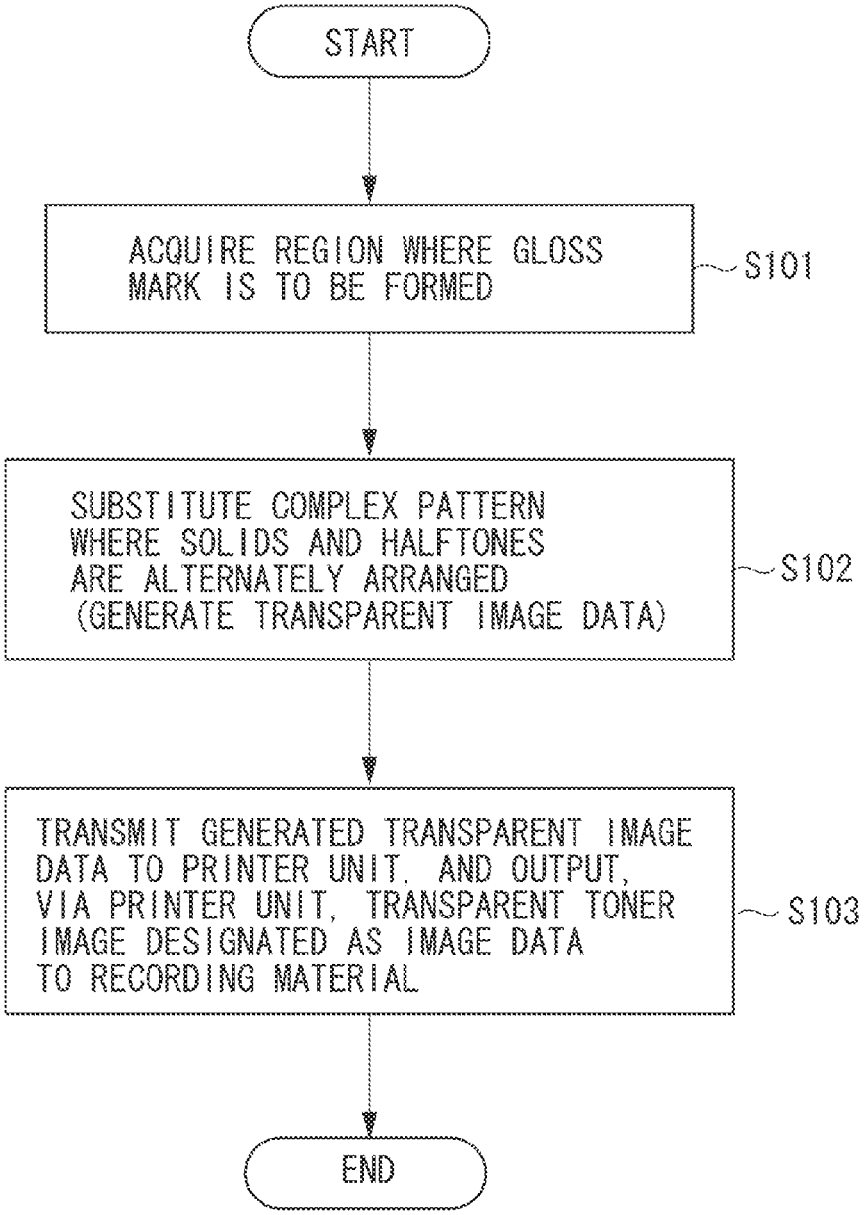
FIG. 7 is a flowchart illustrating a sequence in which a designated region is converted into a pattern image.

FIG. 7 is a flowchart illustrating a control operation performed by the controller 130 of the MFP 100. The controller 130 controls respective units of the MFP 100 according to a program as follows.

In step S101, the CPU 131 acquires a region where a gloss mark designated by the user is to be formed. Subsequently, in step S102, the CPU 131 substitutes image patterns of an entire region where the gloss mark acquired in step S101 is designated to be formed with a complex pattern. More specifically, the image patterns are substituted with a complex pattern where solid patches and halftone patches whose glossiness is different by 10 or more are regularly arranged in the entire designated region at 50 dpi. The image data image-processed as described above, which is used in the transparent station T of the printer unit, is referred to as transparent image data.

In step S103, the CPU 131 transmits the transparent image data generated in step S102 to a laser scanner LS, and controls the printer unit such that a transparent toner image is fixed onto a recording material based on the transparent image data.

A control sequence for controlling the respective units of the image forming apparatus according to a program when the CPU 131 as a control unit forms a gloss mark has been described above.

As illustrated in FIG. 5A, when an entire gloss mark region is to be output uniformly with substantially the same glossiness, a portion of the gloss mark appears defective at a border portion where the glossiness of the gloss mark and the glossiness of the periphery are substantially the same. More specifically, a portion of the gloss mark having a rectangular shape appears defective. In this regard, a gloss mark can be recognized visually regardless of the glossiness of the periphery by forming the gloss mark using a complex pattern as described above. In the following, a test result on a difference in visibility of gloss marks is represented in Table 1.

TABLE 1

| | Background glossiness | | |
|---|---|---|---|
| | Low glossiness | Middle glossiness | High glossiness |
| Uniform (halftone) gloss mark | O | Δ | X |
| Uniform (solid) gloss mark | Δ | X | O |
| Complex pattern gloss mark | O | O | O |

When zero to two of ten examinees can detect an edge, it is expressed by 'X', when three to six examinees can detect an edge, it is expressed by 'Δ', and when seven to ten examinees can detect an edge, it is expressed by '○'. Further, paper U-LITE (glossiness 5) of A4 size manufactured by Nippon Paper Industries Co., Ltd., was used as a recording material, and a pattern illustrated in FIG. 6A with a pattern halftone and solid patch size of 50 dpi was used.

As described above, by disposing a plurality of patches having different glossiness levels at 50 dpi, a gloss mark having an excellent visibility can be output regardless of the glossiness of the periphery of the gloss mark.

In the first exemplary embodiment, an image pattern where a solid region and a halftone region are uniformly combined at a low resolution is used as an image pattern for use in a gloss mark, regardless of the existence of a background chromatic toner image corresponding to the gloss mark forming region. In a second exemplary embodiment of the claimed invention, a gloss mark forming pattern is controlled such that an image pattern of a gloss mark is changed according to the existence of a background chromatic toner image. Further, substantially the same points as in the first exemplary embodiment are designated by the same reference numeral and a description thereof will not be repeated.

Figure 8:
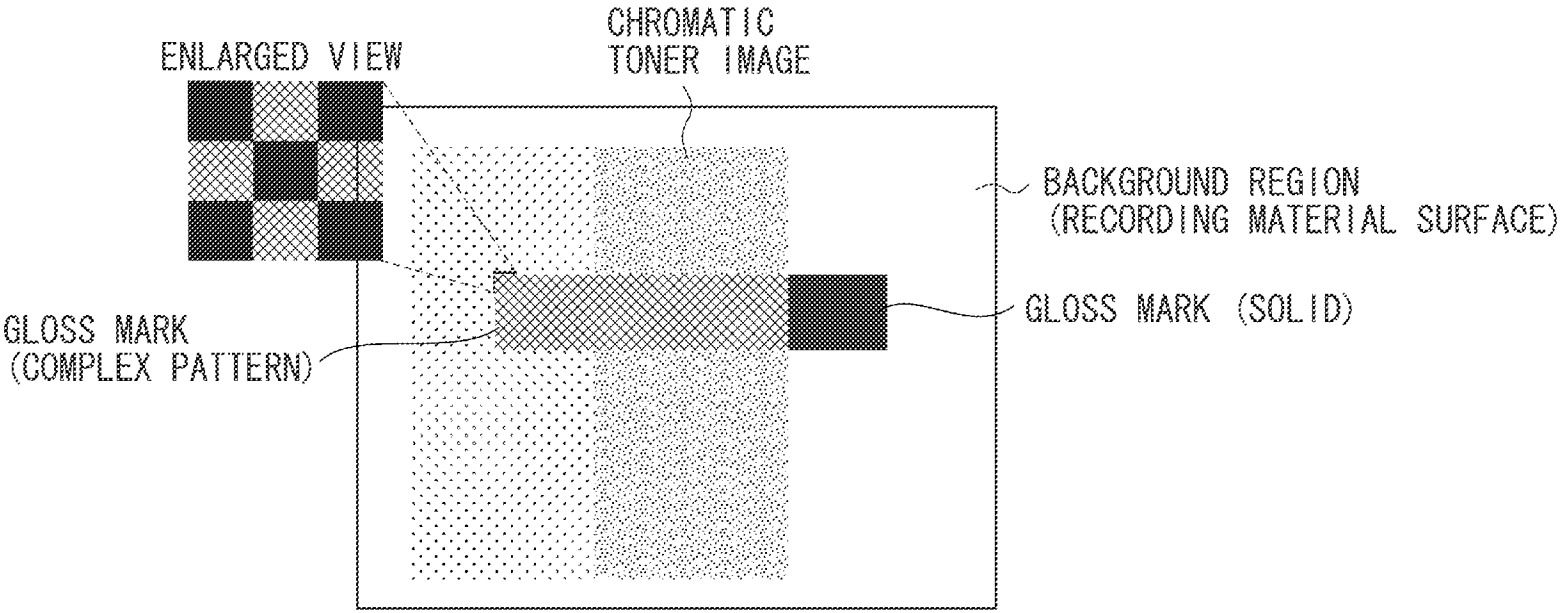
FIG. 8 is a view illustrating gloss marks (mixed).

FIG. 8 is a view illustrating a gloss mark according to the second exemplary embodiment. In the present exemplary embodiment, in a portion of a region where a gloss mark is formed which does not overlap a chromatic toner image, a transparent toner is formed in solid without forming a complex pattern such that a glossiness difference from a recording material increases. Accordingly, it can be clearly recognized visually by an edge of a gloss mark through simple image analysis processing.

More specifically, a gloss mark on a chromatic toner image is controlled such that an image is formed with an image pattern where a solid region and a halftone region are combined at a low resolution like in the first exemplary embodiment. Further, when a gloss mark is formed in a non-chromatic toner image region, an image forming pattern of a gloss mark is controlled such that an image is formed to be a solid image. Since it is unnecessary to consider a gloss difference between a chromatic toner image and a gloss mark because of the non-chromatic toner image region, it is desirable to form an image in a solid image where a clearest gloss difference from a gloss of paper is generated in terms of the visibility of a gloss mark. As a result, it becomes possible to make a gloss difference in the non-chromatic toner image region, that is, in the paper region more significant, and an edge of the gloss mark in a portion overlapping the chromatic toner image can be visually recognized excellently.

Figure 9:
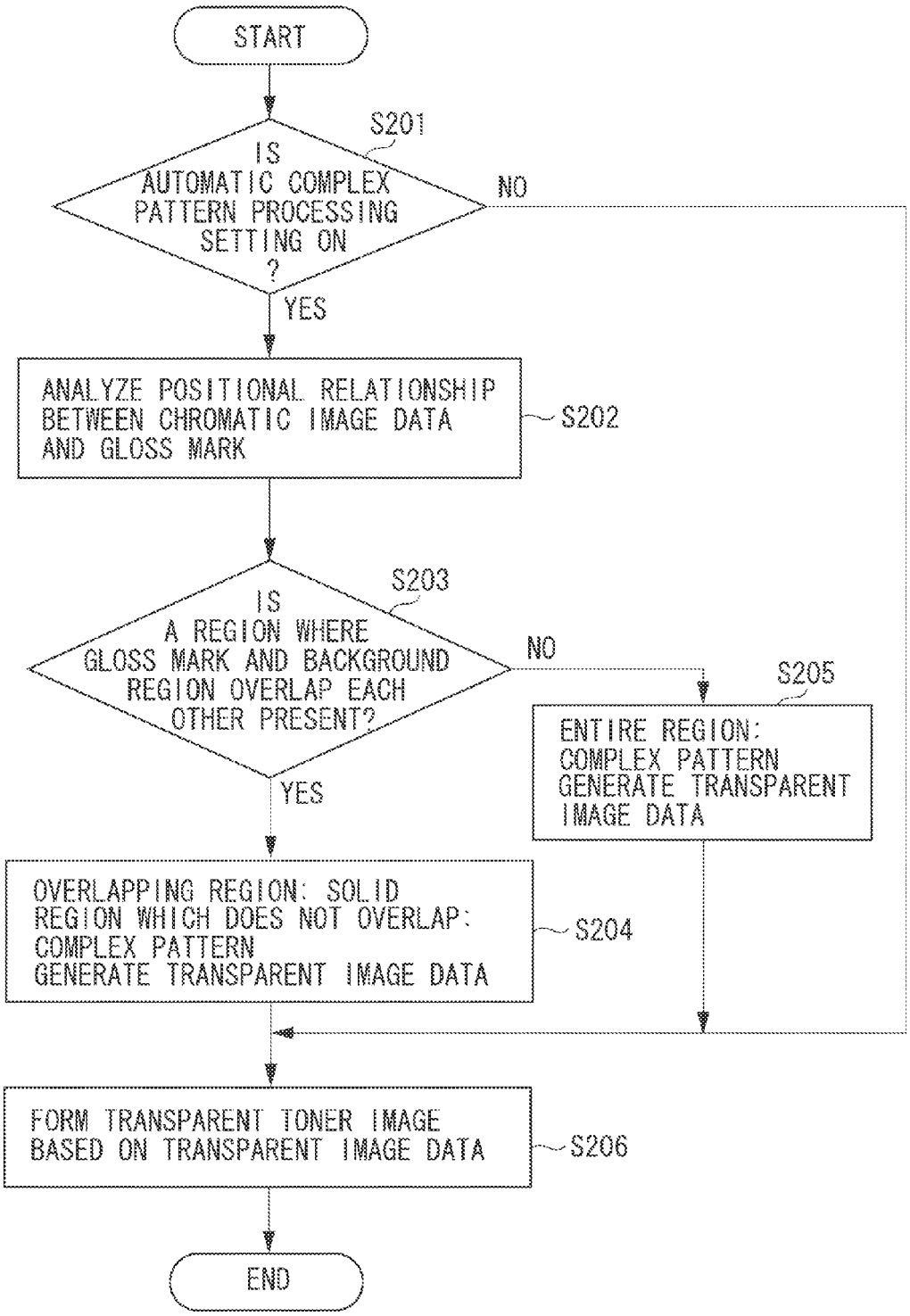
FIG. 9 is a flowchart illustrating a processing sequence where a background portion is taken into consideration.

Next, a sequence of outputting a gloss mark as described above will be described with reference to the flowchart of FIG. 9, which illustrates a processing sequence for outputting a gloss mark according to the present exemplary embodiment. Further, in the present exemplary embodiment, it can be selected whether a gloss mark is to be formed according to image data prepared by the user.

First, in step S201, the CPU 131 as a control unit checks whether transparent image data prepared to form a gloss mark designated by the user when the gloss mark is output by the user will be automatically processed.

When the processing of the gloss mark pattern is not automatically set (NO in step S201), the CPU 131 does not convert the transparent image data prepared by the user into a complex pattern. Then, in step S206, the CPU 131 controls the printer unit such that a toner image is formed on a recording material according to the transparent image data designated by the user.

When the processing of a gloss mark pattern is automatically set (YES in step S201), then in step S202, the CPU 131 analyzes whether a region where a gloss mark is to be formed and a region where a chromatic toner is to be formed overlap each other.

When a white background region and a gloss mark overlap each other (YES in step S203), then in step S204, the CPU 131 generates transparent image data where the overlapping region is expressed by a complex pattern and the portion which is not overlapped is expressed by a solid image.

When the white background region and the gloss mark do not overlap each other (NO in step S203), then in step S205, the CPU 131 generates transparent image data where an entire region forming the gloss mark is expressed by a complex pattern.

Subsequently, in step S206, the CPU 131 controls the printer unit such that a transparent toner image is formed on a recording material based on the transparent image data generated in step S204 or S205.

By making a glossiness difference in the background region significant through the above-described processing, an edge can be made remarkable and a gloss mark which can be visually recognized can be output even in a portion overlapping the chromatic toner image.

In a third exemplary embodiment of the claimed invention, a configuration of changing a patch size of a complex pattern according to the size of paper where a gloss mark is formed will be described. Further, substantially the same points as in the first exemplary embodiment are designated by the same reference numeral and a description thereof will not be repeated.

In the first exemplary embodiment described above, if the resolution is too low when two patches having different glossiness levels are disposed, a jagged feeling of an edge increases if a gloss mark image having a fine shape is drawn, which is undesirable. However, when a person looks at a gloss at a distance as in the case of a poster, if patches are disposed with a resolution substantially the same as the resolution used when a print product is viewed within a distance of a hand, the gloss mark starts to appear as a middle glossiness portion where a solid region and a halftone region are uniform.

In other words, if the resolution where two patches having different glossiness levels are arranged, which is desirable when a gloss mark is output on a recording material corresponding to A4 size paper, is used when a gloss mark is output on a recording material corresponding to A2 size paper, an edge of the gloss mark may not be recognized visually. Thus, it is desirable to change a complex pattern according to the purpose of a print product.

Thus, in the present exemplary embodiment, when the size of a recording material to which a gloss mark is output is less than a predetermined size (A2), the gloss mark is output using a texture where two patches having different glossiness levels are arranged at 50 dpi. Further, when the size of a recording material where a gloss mark is output is equal to or greater than the predetermined size (A2), the gloss mark is output using a texture where two patches having different glossiness levels are arranged at 20 dpi.

Figure 10:
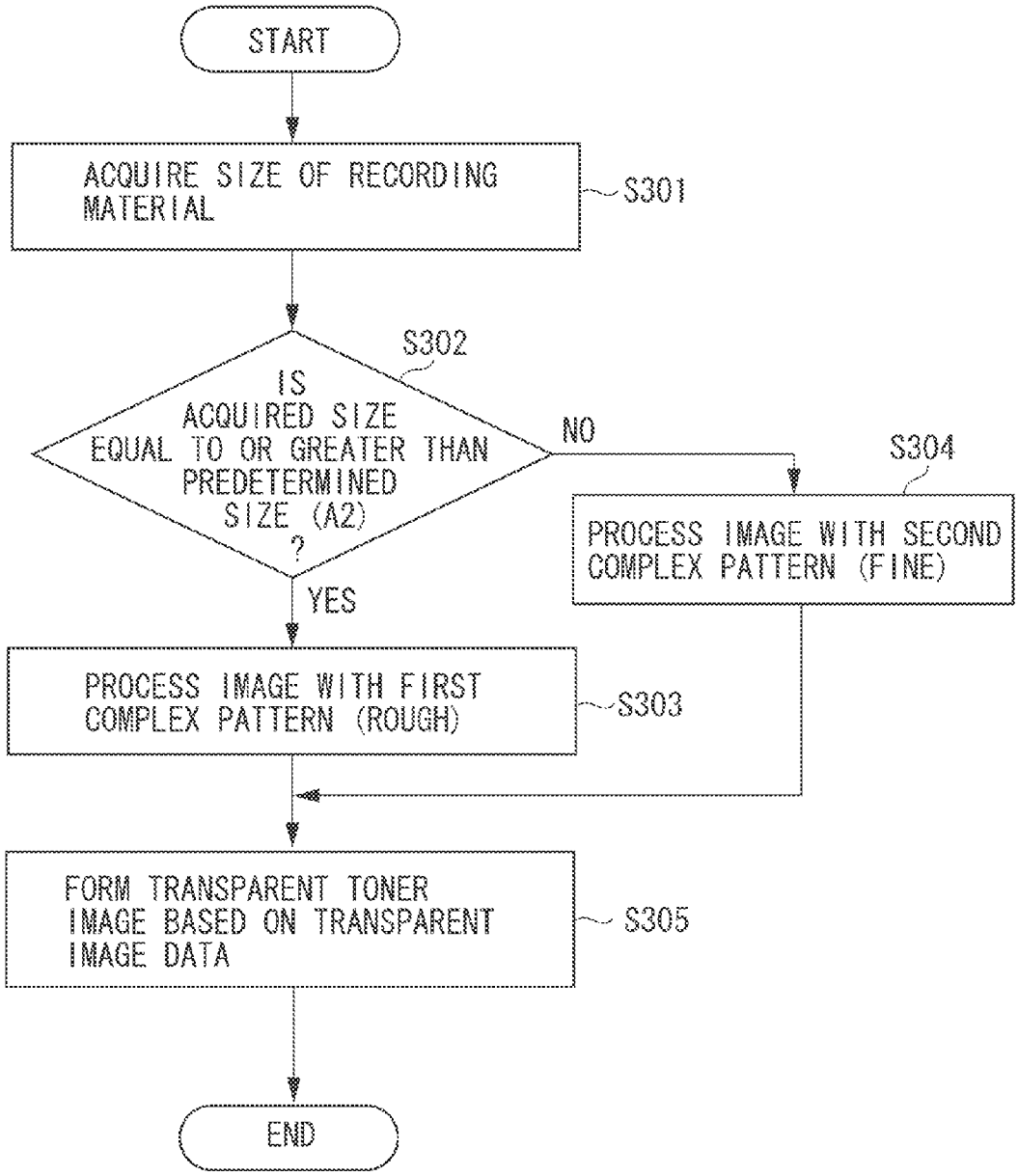
FIG. 10 is a flowchart illustrating a processing sequence where the size of a recording material is taken into consideration.

Hereinafter, a sequence of image processing according to the present exemplary embodiment will be described with reference to the flowchart of FIG. 10, which illustrates a sequence of image processing according to the present exemplary embodiment.

In step S301, the CPU 131, serving as a size acquisition unit for acquiring the size of a recording material, acquires the size of a recording material where a gloss mark is output. More specifically, information on the size of sheets stored in a cassette C in which a recording material is stored is acquired. Further, the information on the size of a sheet may be information of the size set by a user, or may be acquired by using an output of a sensor for detecting the size of a recording material, which is mounted in a transport path for the recording material.

Subsequently, in step S302, the CPU 131 determines whether the size of the recording material acquired in step S301 is equal to or greater than a predetermined size (A2). When the size of the recording material where a gloss mark is output is equal to or greater than A2 (YES in step S302), then in step S303, transparent image data corresponding to a first complex pattern (two patches having different glossiness levels are arranged at 20 dpi) is generated. When the size of the recording material is less than A2 (NO in step S302), then in step S304, transparent image data corresponding to a second complex pattern (two patches having different glossiness levels are arranged at 50 dpi) is generated.

Then, in step S305, the CPU 131 controls the printer unit such that a gloss mark is output on a recording material based on the transparent image data generated in step S303 or S304.

In a fourth exemplary embodiment of the claimed invention, an example of designating a gloss mark or converting transparent image data via a separate device (an information processing apparatus or an image processing apparatus) connected to the image forming apparatus will be described. Further, substantially the same points as in the first exemplary embodiment are designated by the same reference numeral and a description thereof will not be repeated.

Figure 11A:
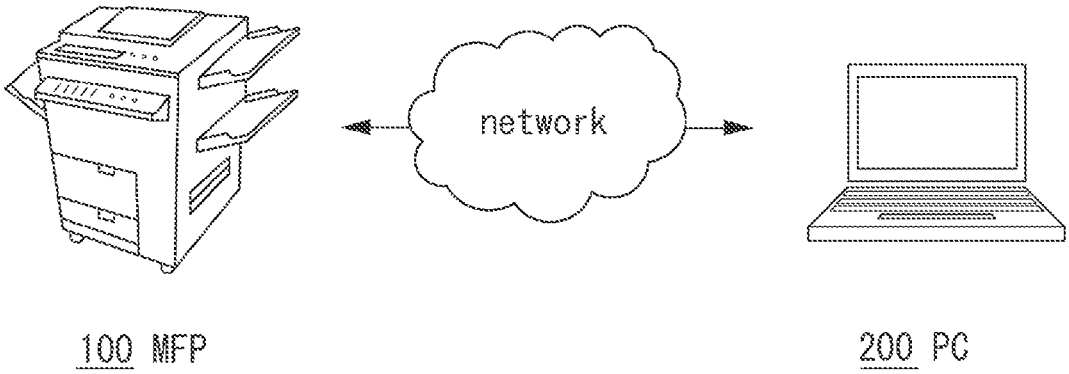
FIGS. 11A and 11B are views illustrating an image processing apparatus.

In the fourth exemplary embodiment, a personal computer (PC) 200 processes an image. Likewise, a user sets a region where a gloss mark is formed by using the PC 200. FIG. 11A is a view illustrating a connection relationship between the MFP 100 and the PC 200 as an information processing apparatus. Further, the MFP 100 and the PC 200 may transmit image data and the like via a network, and a communication method (wired, wireless, or the like) does not matter.

Figure 11B:
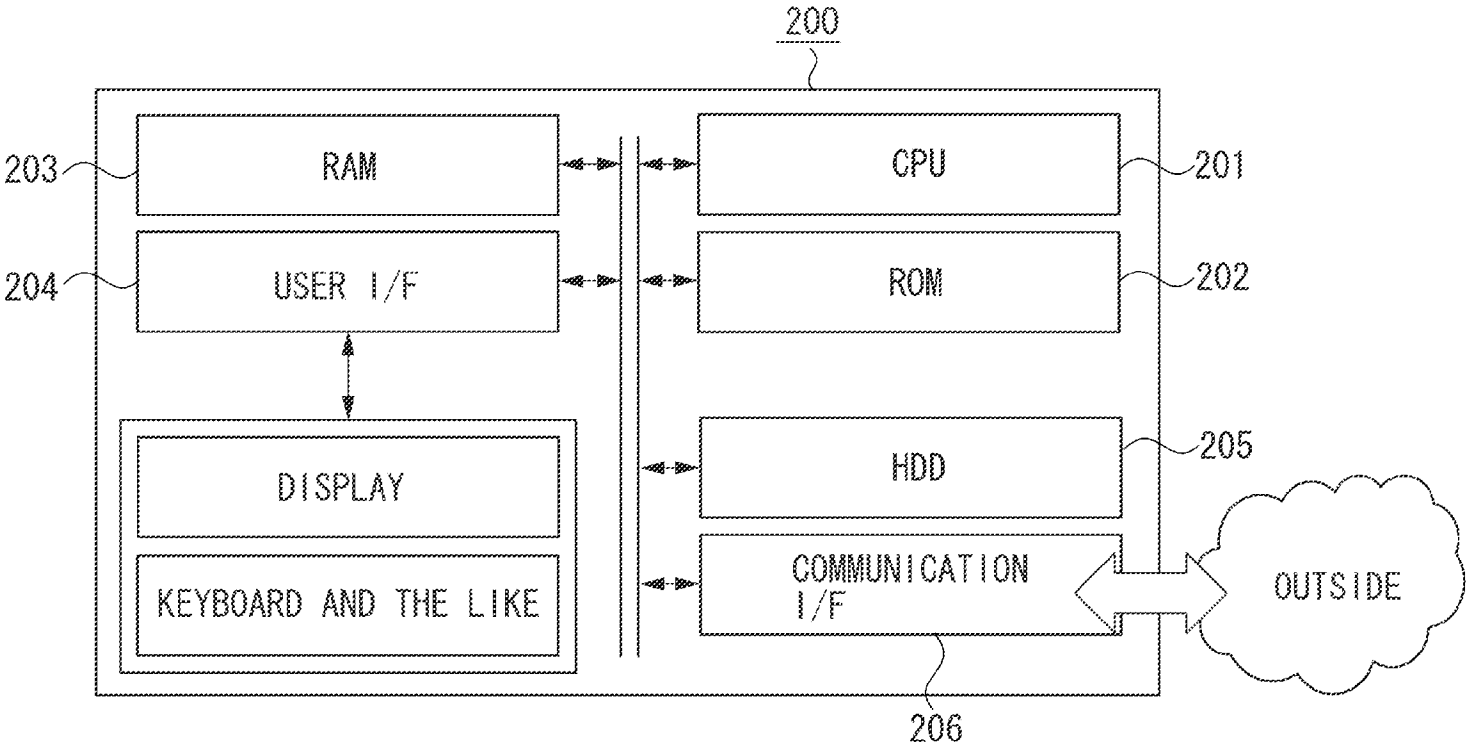

Next, the PC 200 will be simply described. FIG. 11B is a block diagram illustrating a schematic configuration of the PC 200. The PC 200 includes a CPU 201, a ROM 202, a RAM 203, a user I/F 204, an HDD 205, and a communication I/F 205.

The PC 200 manages and controls various hardware components constituting the PC 200 according to programs recorded in the ROM and the like. The CPU 201 acquires various operations from a user through a keyboard and the like via the user I/F 204. Further, a screen for setting information transmitted to the MFP 100 is displayed on a display. Further, the CPU 201 as an image processing unit may transmit image data or various instructions to the outside via the communication I/F 206.

The CPU 201 in the present exemplary embodiment executes the image processing described in the first to third exemplary embodiments, and transmits the processed image data and various control instructions to the MFP 100, thus performing the same function as the controller 130 in the first to third exemplary embodiments.

Figure 12A:
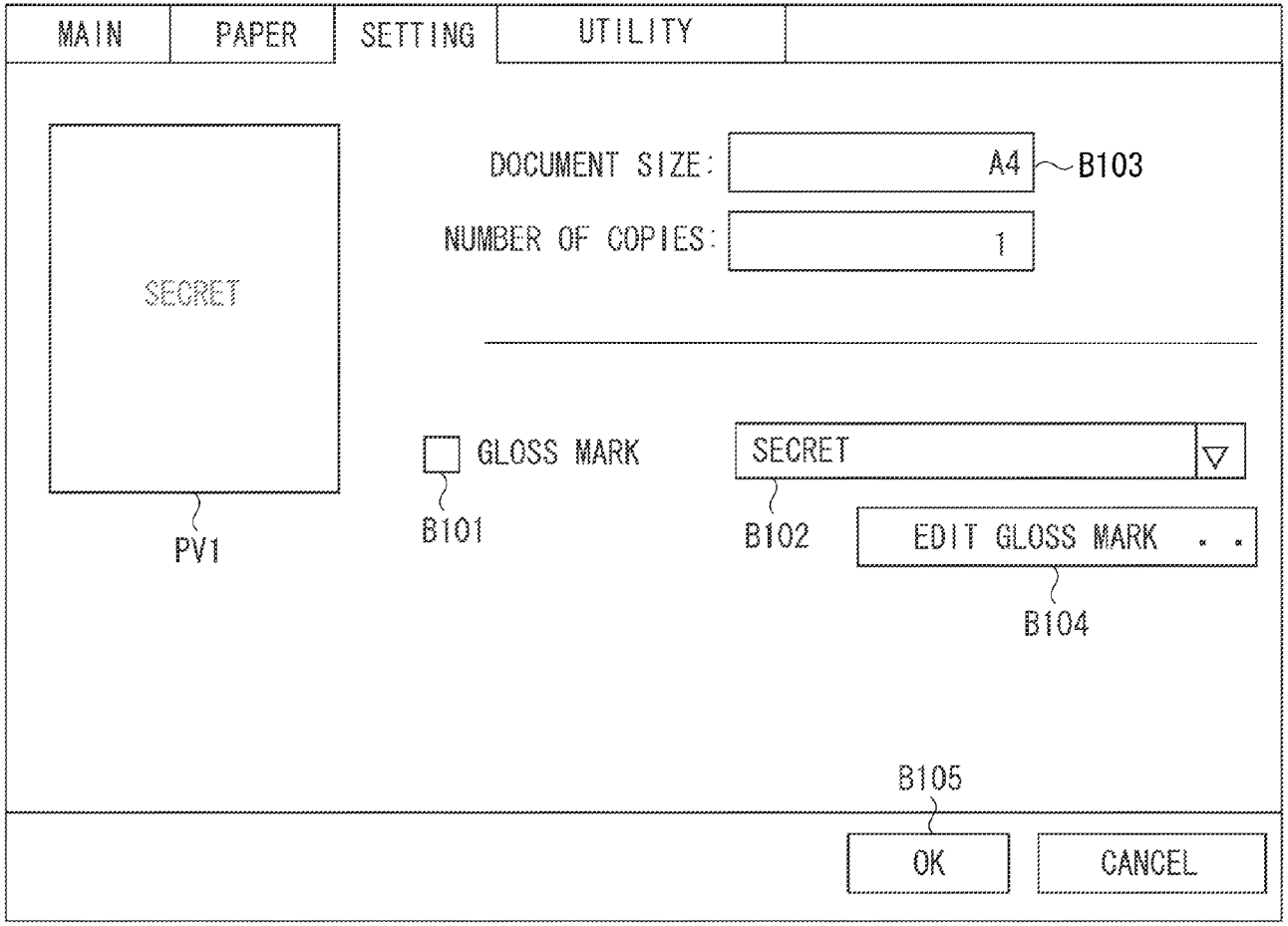
FIGS. 12A and 12B are views each illustrating an example of a screen displayed on a display.
Figure 12B:
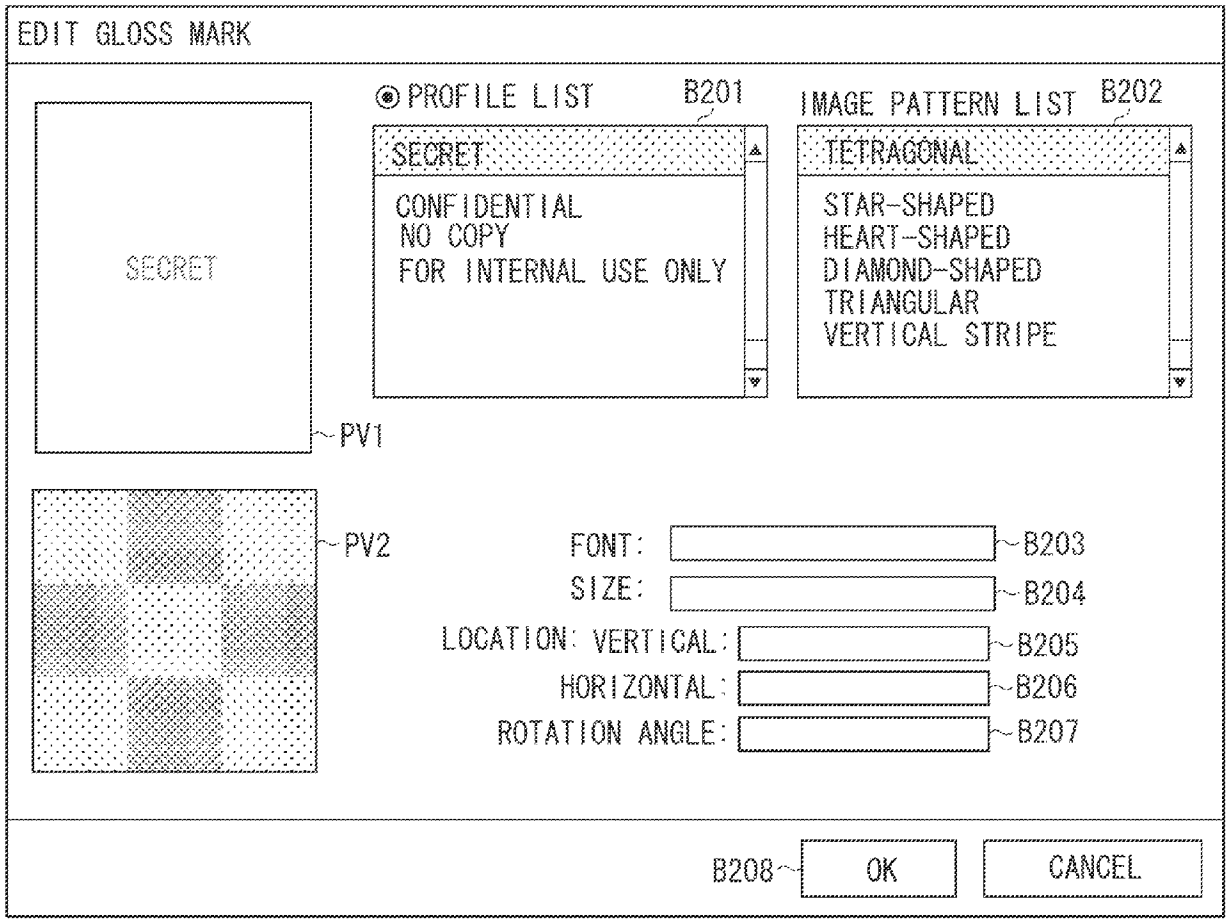

Next, image data transmitted from the PC 200 to the MFP 100 and a screen for setting various printing conditions will be described. FIGS. 12A and 12B are views each illustrating a printing setting dialogue screen displayed by a user interface unit of a printer driver.

A check box B101 is a button for setting whether a gloss mark will be added to a recording material. By selecting the check box B101, the PC 200 generates and transmits transparent image data used to form a gloss mark to the MFP 100.

A list box B102 is used to select a specified pattern in a gloss mark to be output to the recording material from the list. In FIG. 12A, 'Secret' is selected as a gloss mark. Accordingly, a letter 'Secret' is displayed as a gloss mark actually formed on the recording material on a preview screen PV1.

A list box B103 is used to designate the size of a document. The size of the document set via the list box B103 is acquired by the CPU 201, and is used to set a patch resolution according to the size of the recording material as described in the third exemplary embodiment. A button B104 is used to shift a screen for various settings of the gloss mark. By selecting the button B104, the screen displayed on the display is shifted from the screen illustrated in FIG. 12A to the screen illustrated in FIG. 12B. A button B105 is used to start forming an image in a set condition. If the user selects the button B105, the dialogue is closed and image data and control information for operating the MFP 100 in an image forming condition selected on the setting screen are transmitted to the MFP 100 via the communication I/F 206.

Next, a detailed setting screen for a gloss mark will be described. FIG. 12B illustrates a screen displayed when the button B104 is selected. A list box B201 is used to change a figure to be formed on a recording material as a gloss mark. Accordingly, a figure of 'No Copy' and the like can be selected in addition to 'Secret'. The figure selected by the user is displayed on the preview screen PV1.

A list box B202 is used to designate shapes (image patterns) of patches having different glossiness levels. When 'Rectangular' is selected, a gloss mark is processed in a texture where rectangular tiles are regularly arranged in the patch. As the image pattern selected by the box B202 is displayed on the preview screen PV2, details of the image pattern can be confirmed. Further, a texture pattern, a profile, or the like may be read out from image data and the like in the PC.

Next, setting boxes B203 to B207 are used to designate a font, a size, a disposition, and a rotation angle of a gloss mark. A user can set a desired proper parameter by using a keyboard. The various setting information on the gloss mark set as described above is reflected by selecting an OK button B208. When the OK button B208 is selected, the dialogue illustrated in FIG. 12B is closed, and is then shifted the screen illustrated in FIG. 12A.

In this way, the transparent image data or control instructions generated based on the set information are transmitted to the MFP 100, and a print product as described in the above-described exemplary embodiments is output.

While the claimed invention has been described with reference to exemplary embodiments, it is to be understood that the claimed invention is not limited to the disclosed exemplary embodiments. The scope of the following claims is to be accorded the broadest interpretation so as to encompass all modifications, equivalent structures, and functions.

What is claimed is:

1. An image forming apparatus comprising:

a transparent image forming unit configured to form a transparent toner image on a recording material;

a fixing unit configured to fix the transparent toner image formed on the recording material;

an acquisition unit configured to acquire a region where a mark visually recognizable due to a glossiness difference is to be formed; and a control unit configured to control the transparent image forming unit such that the transparent toner image formed in the region acquired by the acquisition unit is formed in a predetermined pattern in which a first portion having first glossiness after fixing and a second portion having second glossiness after fixing that is different from the first glossiness are at least alternately disposed, wherein an interval between adjacent ones of the first portions in the predetermined pattern is equal to or less than a predetermined distance.

2. The image forming apparatus according to claim 1, wherein the interval between adjacent ones of the first portions in the predetermined pattern is equal to or less than 50 dpi (dots per inch).

3. The image forming apparatus according to claim 1, further comprising a chromatic image forming unit configured to form a chromatic toner image on the recording material, wherein the control unit is configured to perform control such that the predetermined pattern is formed on at least a region, in which the chromatic toner image is formed, of the region acquired by the acquisition unit.

4. The image forming apparatus according to claim 1, further comprising a size acquisition unit configured to acquire a size of the recording material where the transparent toner image is formed, wherein the control unit changes the interval at which the first portions of the pattern are disposed to be larger when the size acquired by the size acquisition unit is large than when the size acquired by the size acquisition unit is small.

5. An image processing apparatus that processes image data to be transmitted to an image forming unit that forms a transparent toner image on a recording material, the image processing apparatus comprising:

an acquisition unit configured to acquire a region where a region visually recognizable due to a glossiness difference is to be formed; and an image processing unit configured to generate image data to form a transparent toner image in the region acquired by the acquisition unit to have a pattern including first portions disposed along a predetermined direction of the recording material at a predetermined interval and having first glossiness after fixing and second portions disposed to be adjacent to the first portions and having second glossiness lower than the first glossiness by 5 or more after fixing.

6. The image processing apparatus according to claim 5, wherein the interval between adjacent ones of the first portions in the pattern is equal to or less than 50 dpi (dots per inch).

7. The image processing apparatus according to claim 1, wherein the first glossiness and the second glossiness have a glossiness difference equal to or greater than 5.

* * * * *